US005222354A

United States Patent [19]

Rothstein

[11] Patent Number: 5,222,354

[45] Date of Patent: Jun. 29, 1993

[54] APPARATUS FOR CHAIN LINK REMOVAL AND REPLACEMENT

[76] Inventor: Larry A. Rothstein, 11550 Magnolia St., NW., Coon Rapids, Minn. 55448

[21] Appl. No.: 985,605

[22] Filed: Dec. 3, 1992

[51] Int. Cl.[5] ..... B21L 21/00

[52] U.S. Cl. ..... 59/7; 59/11

[58] Field of Search ..... 59/7, 11; 72/454; 29/283, 505, 517, 525

[56] References Cited

U.S. PATENT DOCUMENTS

| | | | |
|---|---|---|---|
| 1,000,867 | 8/1911 | Widmayer et al. | 59/7 |
| 2,895,289 | 7/1959 | Wognum et al. | 59/7 |
| 2,904,955 | 9/1959 | Kreiter | 59/7 |
| 3,553,960 | 9/1968 | Ellefson | 59/11 |
| 4,282,707 | 8/1981 | Fox | 59/11 |
| 4,833,875 | 5/1989 | Buermann, Jr. | 59/7 |

*Primary Examiner*—David Jones
*Attorney, Agent, or Firm*—Patterson & Keough

[57] ABSTRACT

A tool for in-place removal and replacement of large roller-type links of heavy duty chains adapted for use in industrial settings. The tool includes a detachable back support, a front support and a drive mechanism. The front support includes a plurality of holding bolts. The drive mechanism is secured to the front support and includes a crossbar and a plurality of drive screws. To remove a side plate of a link, the drive screws are aligned over the ends of the link pins and the back and front supports are secured to each other around the link with the holding bolts. The drive screws then are rotated to force the side plate of the link from the link pins. To reassemble the link, the crossbar is aligned with the side plate and the back and front supports are secured to each other around the link with the holding bolts. Tightening the holding bolts moves the crossbar to apply even pressure against the side plate thereby forcing the side plate into position in the link.

8 Claims, 2 Drawing Sheets

APPARATUS FOR CHAIN LINK REMOVAL AND REPLACEMENT

TECHNICAL FIELD

The present invention deals broadly with the field of devices to remove or replace particular links within a chain. More specifically, it deals with an improvement to a tool for removing and replacing links in large roller chains while retaining the chain in place through the removal or replacement of chain pins and side plates.

BACKGROUND OF THE INVENTION

The size and utility of any chain is dependent on the type and size of the links in the chain. Large roller-type links are often 2–8 inches in length and may be 12 inches or more in length. In industrial conveyor systems, for example, large roller-type links are commonly used to form heavy duty roller chains that drive conveyor systems. Problems arise in industrial conveyor systems when any link in the conveyor chain is damaged or broken. Removing the entire chain from an industrial conveyor system in order to replace a weakened link is difficult, time consuming and expensive. Thus, it is preferable to remove and replace any link in the conveyor chain while the chain remains in place on the conveyor system rather than removing the chain from the conveyor system and using a workbench to repair the chain.

The problem of removing or replacing a link in a chain, especially in place removal of links in large roller chains, is well-known and has been described in detail in, for example, U.S. Pat. No. 2,895,289 (Wognum). Prior art tools generally provide an apparatus to cradle the chain such that the cradle integrates the mechanism for removing or replacing the links with adequate backing to counter the force required to remove the link pins. Unfortunately, the prior art tools sometimes are inadequate when large roller chains need to be repaired because of the large size of the tool required and the absence of space in which to position such a large tool when the chain is in place in with industrial equipment, for example.

For the large roller chains used in industrial conveyors, the traditional method of in-place removal of the link pins is with a shank and a hammer. Typically, the end of the shank is positioned on the end of a link pin and the hammer is used to strike the shank, forcing the link pin out of the link. The pins are usually removed one at a time. The amount of force required to free the pins is great and using a hammer to apply such force is dangerous and imprecise. The lack of control of the force frequently causes the weakened link to fracture unexpectedly or the pins to suddenly pop out, endangering the worker.

An objective of the present invention is the safe removal and replacement of link pins and links in large roller chains while the chain remains in place.

Another objective of the present invention is to provide a tool that can be used in a limited amount of space despite the large size of a chain link.

A further objective of the present invention is to provide a tool that can be used manually or with power tools and is adaptable for chains of varying widths.

SUMMARY OF THE INVENTION

The present invention is an improved apparatus for in-place removal and replacement of large roller-type links of heavy duty chains such as are commonly used in industrial conveyor systems. The present invention provides a detachable back support to hold the link during the removal and replacement of the link side plate in combination with drive screws to control the amount of force necessary to remove or replace the link side plate on the link pins. Use of the detachable back support and drive screws enables the apparatus to be used in industrial settings when it is not desirable to remove the chain from the conveyor or where access space to the chain is limited.

The tool hereof includes a back support, a front support and a drive mechanism. The drive mechanism is secured to the front support and includes a crossbar and a plurality of drive screws. In operation, the back support and front support are operably, detachably coupled across the link whereby the crossbar of the drive mechanism is aligned parallel to the link side plate and the drive screws are positioned over the ends of the link pins. Once the tool is in place, the drive screws are rotated to force the side plate of the link from or onto the link pins.

DETAILED DESCRIPTION OF THE INVENTION

Figure 1:
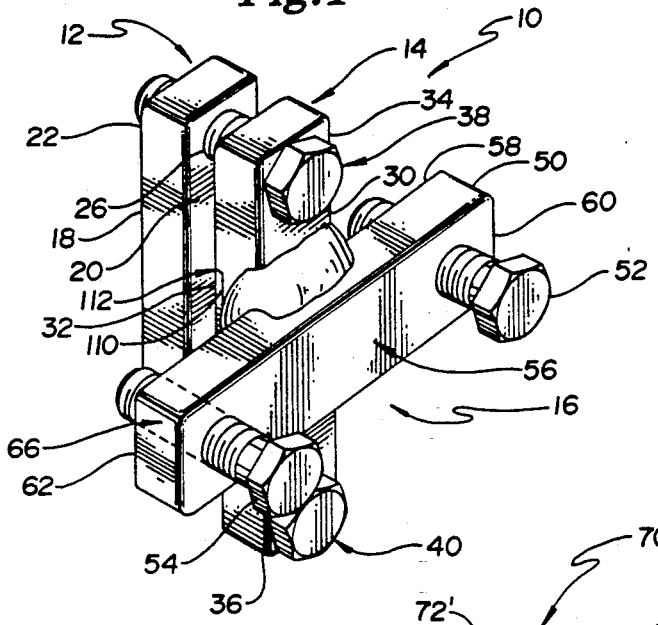
FIG. 1 is a perspective view of a tool in accordance with the present invention.
Figure 2:
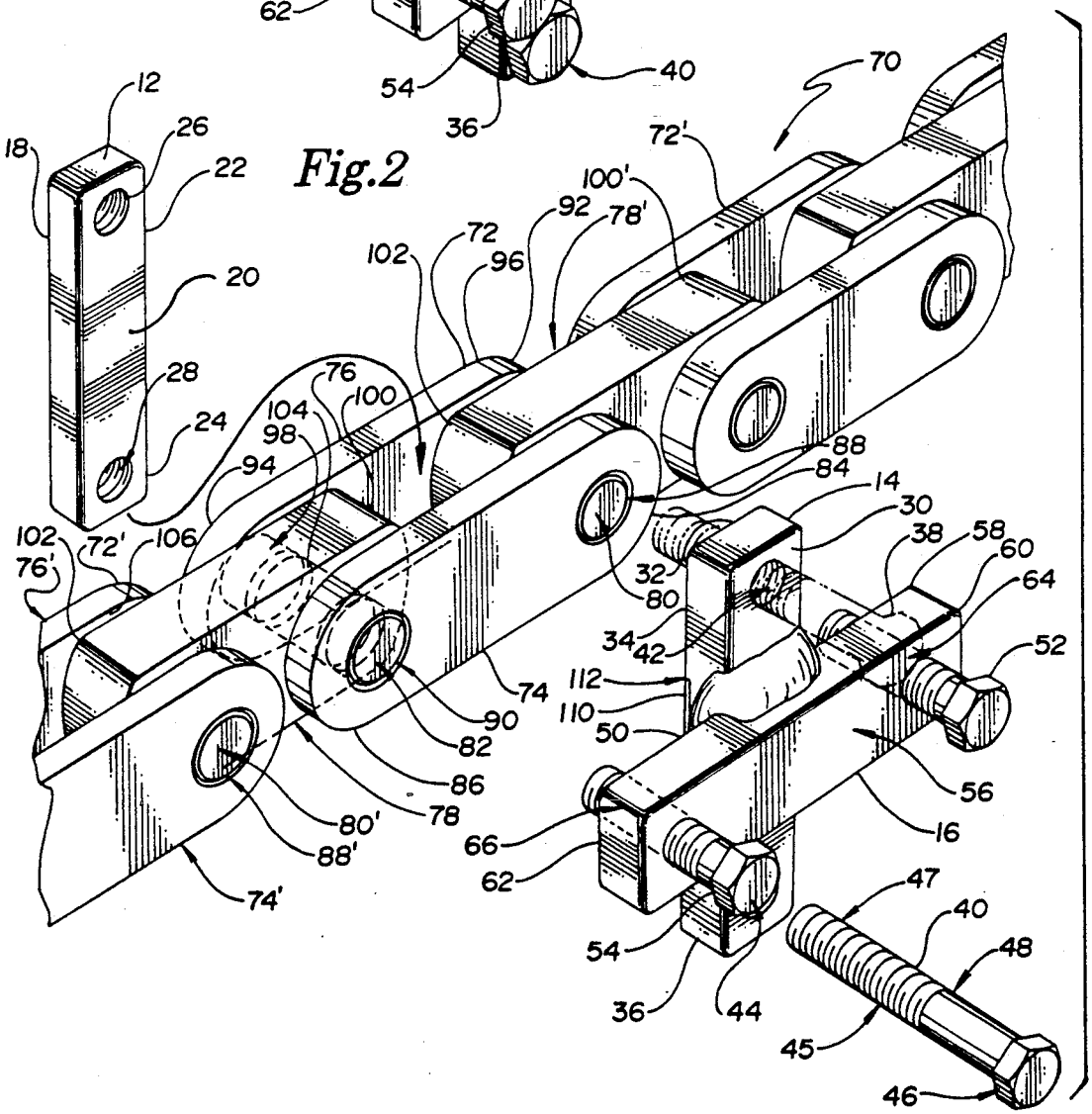
FIG. 2 is an exploded, perspective view of a tool in accordance with the present invention depicted in conjunction with a portion of a chain.

Referring now to the drawings, wherein like reference numerals denote like elements throughout the several views, FIG. 1 illustrates a tool 10 in accordance with the present invention. Referring to FIGS. 1 and 2, in the preferred embodiment, the tool 10 comprises a back support 12, a front support 14 and a drive mechanism 16. The back support 12 includes an outer face 18, an inner face 20, an upper end 22 and a lower end 24. The upper end 22 and lower end 24 each includes structure defining a circular threaded cavity 26, 28. The threaded cavities 26, 28 extend from the inner face 20 through the back support 12 to the outer face 18.

In the preferred embodiment, the front support 14 is generally rectangular in shape and carries an outer face 30, an inner face 32, an upper end 34, a lower end 36 and a plurality of holding bolts 38, 40. The upper end 34 of the front support 14 includes structure defining a circular upper bolt cavity 42 of sufficient diameter to accept the holding bolt 38. The lower end 36 of the front support 14 includes structure defining a circular lower bolt cavity 44 of sufficient diameter to accept the holding bolt 40. Both bolt cavities 42, 44 extend from the outer face 30 of the front support 14 to the inner face 32.

The front support upper bolt cavity 42 and the back support upper end cavity 26 are aligned such that the holding bolt 38 of the front support 14 may pass through the upper bolt cavity 42 of the front support 14 and the upper end cavity 26 of the back support 12. The front support lower bolt cavity 44 and the back support lower end cavity 28 are positioned such that the holding bolt 40 passes through the lower bolt cavity 44 of the front support 14 and the lower end cavity 28 of the back support 12.

As shown in FIG. 2 and with reference to holding bolt 40, in the preferred embodiment, each of the holding bolts 38, 40 include a circular shaft 45 and a hexagonal lug head 46. The circular shaft 45 includes a lower threaded portion 47 and an upper clearance portion 48. It will be understood by those skilled in the art that other common bolt heads, such as a screw head or a hex head, could also be used.

The drive mechanism 16 includes a generally rectangular cross bar 50, a right drive screw 52 and a left drive screw 54. In the preferred embodiment, the drive mechanism 16 is welded to the front support 14 such that the cross bar 50 is generally perpendicular to the front support 14 and located between the upper bolt cavity 42 and the lower bolt cavity 44 of the front support 14. It will be recognized, however, that the drive mechanism 16 and the front support 14 could also be a single integral cross-like member formed by a single piece of steel, for example.

The cross bar 50 carries an outer face 56, an inner face 58, a right end 60 and a left end 62. The right end 60 of the crossbar 50 includes structure defining a circular threaded right drive bore 64 of sufficient diameter to receive the right drive screw 52. The left end 62 of the crossbar 50 includes structure defining a circular threaded left drive bore 66. The left drive bore 66 is of sufficient diameter to receive the left drive screw 54. The right drive bore 64 and the left drive bore 66 both extend from the outer face 56 of the crossbar 50 to the inner face 58.

Referring to FIG. 2, the chain 70 includes a plurality of links 72, 72' joined in a series. (For purposes of the description, it will be understood that corresponding elements of each link that will be designated with the use of the ' symbol.) Each link 72 includes a right side plate 74, left side plate 76, connecting plate 78, upper link pin 80 and lower link pin 82. The right plate 74 includes an upper end 84 and a lower end 86. The upper end 84 of the right side plate 74 includes structure defining the upper pin hole 88. The lower end 86 of the right side plate 74 includes structure defining the lower pin hole 90. Both the upper pin hole 88 and the lower pin hole 90 extend through the right side plate 74. All pin holes described herein are generally circular in shape and of sufficient diameter to receive a link pin 80, 82.

The left side plate 76 includes an upper end 92 and a lower end 94. The upper end 92 of the left side plate 76 includes structure defining the left upper pin hole 96. The lower end 94 of the left side plate 76 includes structure defining a left lower pin hole 98. Both the upper pin hole 96 and the lower pin hole 98 extend through the left side plate 76.

The connecting plate 78 includes an upper end 100 and a lower end 102. The upper end 100 of the connecting plate 78 includes structure defining an upper connecting pin hole 104. The lower end 102 of the connecting plate 78 includes structure defining a lower connecting pin hole 106. Both the upper pin hole 104 and the lower pin hole 106 extend through the connecting plate 78.

The link pins 80, 82 operably couple the right side plate 74 and the connecting plate 78 and the left side plate 76 by being riveted into place in the pin holes 88, 90, 96, 98, 104, 106. Specifically, the upper link pin 80 is inserted through the upper pin hole 88 of the right side plate 74, the lower pin hole 106' of the connecting plate 78' of a like link 72' and the upper pin hole 96 of the left side plate 76. The lower link pin 82 is inserted through the lower pin hole 90 of the right side plate 74, the upper pin hole 104 of the connecting plate 78 and the lower pin hole 98 of the left side plate 76.

The back support 12 and the front support 14 are of sufficient height such that the upper end cavity 26 and the lower end cavity 28 of the back support 12 are positioned above and below respectively of the chain links. The front support 14 is of sufficient height that the upper bolt cavity 42 is positioned above the link 78 and the lower bolt cavity 44 is positioned below the link 72 when the tool is in operation. The holding bolts 38, 40 are of sufficient length to extend from the outer face 30 of the front support 14 through the front support 14 and the back support 12 to the outer face 18 of back support 12. The right drive bore 64 and the left drive bore 66 of the drive mechanism 16 are positioned such that the drive screws 52, 54 are aligned with the upper pin hole 88 of the right plate 74 and the lower pin hole 90 of the right plate 74.

In an alternate embodiment, the inner face 32 of the front support 14 presents structure defining a link guide 110. The link guide 110 includes an upper lip 112.

In an alternate embodiment, the front support 14 and crossbar 50 also present structure defining complementary meld depressions (not shown) for ease in attaching the drive mechanism 16 to the front support 14 whereby the drive bores 64, 66 are aligned with the pin holes 88, 90.

In operation, the back support 12 is placed within the cavity defined by the right and left side plate 74, 76 and the connecting plates 78, 78'. Next, the holding bolts 38, 40 are inserted in the upper and lower bolt cavities 42, 44 from the outer face 30 of the front support 14 and are screwed into the upper and lower threaded cavities 26, 28 from the inner face 20 and extending beyond the outer face 18 of the back support 12. The holding bolts 38, 40 secure the front support 14 and back support 12 together whereby the right side plate 74 of the link 72 is secured and supported. The tool 10 supports only the side plate of the link being repaired thereby requiring minimal space in which to operate. In an alternate embodiment, the upper lip 112 of the link guide 110 rests on the right side plate 74 whereby the link guide 110 aligns the drive bores 64, 66 with the pin holes 88, 90.

Figure 3:
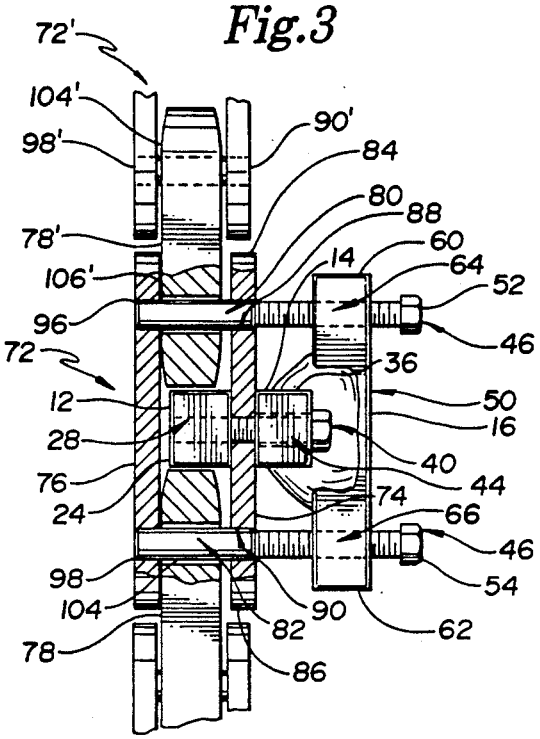
FIG. 3 is a sectional, side elevational view of the tool in place on the link of a chain.

Referring to FIG. 3, in operation, the right drive screw 52 and left drive screw 54 are aligned with the upper link pin 80 and the lower link pin 82. Next, the drive screws 52, 54 are rotated to force the link pins 80, 82 from the corresponding pin holes 88, 90 of the right side plate 74. The drive screws 52, 54 may be rotated by hand or through the use of power tools designed to grip the lug heads 46 of the screws 52, 54.

Figure 4:
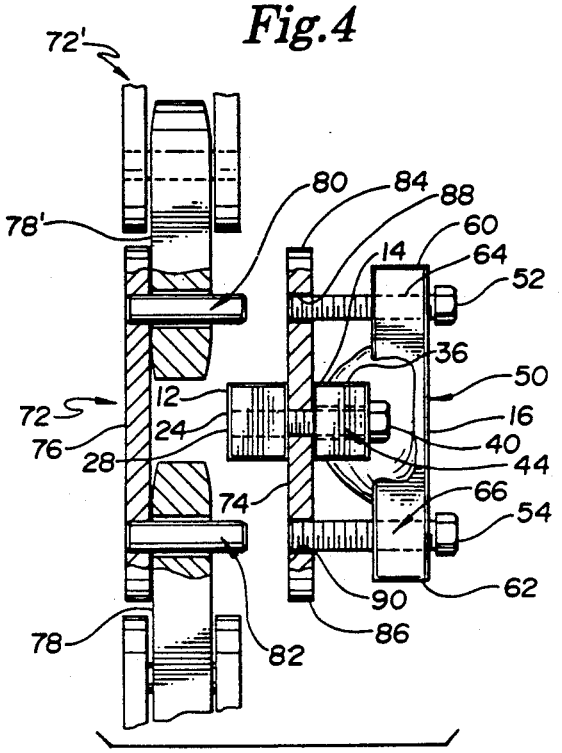
FIG. 4 is similar to FIG. 3 but with a link removed by the tool.

Referring to FIG. 4, once the link pins 80, 82 have been forced from the pin holes 88, 90, the drive screws 52, 54 grip the right side plate 74 within the upper pin hole 88 and lower pin hole 90. Working in combination, the drive screws 52, 54 and the front support 14 and back support 12 cradle the right side plate 74 as the right side plate 74 is removed from the link 72.

Figure 5:
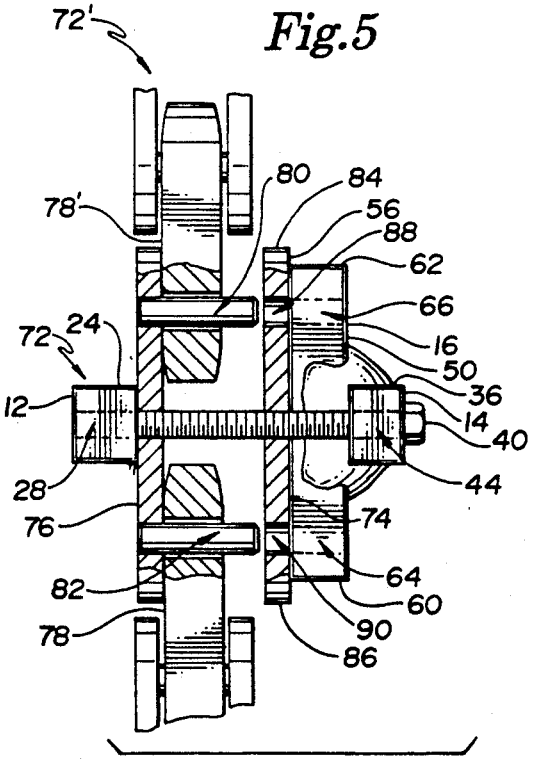
FIG. 5 is a sectional side elevational view of the tool positioned to install a new link onto a chain.
Figure 6:
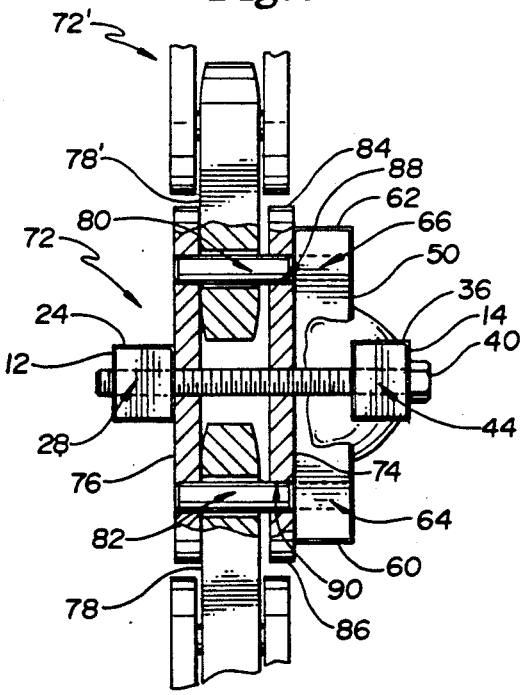
FIG. 6 is similar to FIG. 5 but depicting the tool positioned as a link is replaced.

Referring to FIGS. 5 and 6, the replacement of the right side plate 74 is accomplished by removing the drive screws 52, 54 from the drive bores 64, 66 and placing the outer face 56 of the crossbar 50 flush against the right side plate 74 such that the right and left drive bores 64, 66 are aligned with the pin holes 88, 90 of the right side plate 74 and the pin holes 88, 90 are aligned with the link pins 80, 82. The back support 12 is placed along the left side plate 76 such that the threaded cavities 26, 28 are aligned with the holding bolts 38, 40 of the front support 14. Turning the holding bolts 38, 40 moves the crossbar 50 to exert even pressure on the right side plate 74 whereby the right side plate 74 is forced onto the link pins 80, 82 and into operable contact with the connecting plates 78, 78'.

Numerous characteristics and advantages of the invention have been set forth in the foregoing description. It will be understood, of course, that this disclosure is, in many respects, only illustrative. Changes can be made in details, particularly in the matters of shape, size and arrangement of parts within exceeding the scope of the invention. The invention scope is defined by the language by which the appendant claims are expressed.

I claim:

1. An apparatus for removing and replacing chain links in a heavy duty roller chain, said links including a pair of opposing side plates, a connecting plate and a plurality of link pins, each of said side plates carrying an inner and an outer surface, said side plates and said connecting plate defining opposed pin holes for receiving said link pins, said link pins operably, detachably coupled to said side and connecting plates whereby said link pins are inserted in said pin holes, said apparatus comprising:

a front support means having an upper end and a lower end for engaging an outer surface of one of said side plates of said link, said upper end extending above said side plate and said lower end extending below said side plate;

a back support means having an upper and a lower end detachably coupled to said front support for engaging an inner surface of said one of said side plates or an outer surface of said other of said side plate, said upper end extending above said side plate and said lower end extending below said side plate such that said link is positioned between said back support and said front support; and a drive mechanism operably coupled to said front support, said drive mechanism including a crossbar member and a plurality of drive members, said crossbar member defining opposed bores aligned with said pin holes of said side plates for receiving said drive members whereby insertion of said drive members in said opposed bores of said crossbar member forces said link pins from said pin holes.

2. The apparatus as claimed in claim 1, said front support means defining a plurality of cavities, said cavities positioned in said upper end and said lower end of said front support means.

3. The apparatus as claimed in claim 2, said back support means defining a plurality of threaded cavities, said cavities positioned in said upper end and said lower end of said back support means whereby said cavities are aligned with said front support threaded cavities.

4. The front support means as claimed in claim 3 further including a plurality of adjusting members, said adjusting members operably engaged with said cavities for detachably coupling said front support means to said back support means.

5. The adjusting members as claimed in claim 4 being partially threaded bolt screws.

6. The apparatus as claimed in claim 1, said opposed bores of said crossbar member being threaded.

7. The apparatus as claimed in claim 6, said drive members of said drive mechanism being screws whereby said screws are operably engaged with said bores of said crossbar member.

8. The apparatus as claimed in claim 1, said crossbar member presenting structure defining a link guide for aligning said opposed bores with said pin holes of said side plates.

* * * * *